US007497035B2

(12) United States Patent
Kos et al.

(10) Patent No.: US 7,497,035 B2
(45) Date of Patent: Mar. 3, 2009

(54) SOCCER TRAINING APPARATUS AND METHOD

(76) Inventors: Alexander I. Kos, 961 Orchid Dr., Brentwood, CA (US) 94513; Sylvain Y. Koffi, 256 Elmwood La., Hayward, CA (US) 94541

( * ) Notice: Subject to any disclaimer, the term of this patent is extended or adjusted under 35 U.S.C. 154(b) by 426 days.

(21) Appl. No.: 11/368,090

(22) Filed: Mar. 2, 2006

(65) Prior Publication Data

US 2006/0196084 A1 Sep. 7, 2006

Related U.S. Application Data

(60) Provisional application No. 60/658,253, filed on Mar. 2, 2005.

(51) Int. Cl.
*A43B 5/02* (2006.01)
*A43B 23/00* (2006.01)

(52) U.S. Cl. ..... 36/133; 36/139; 36/128; 36/7.2; 473/446

(58) Field of Classification Search ..... 36/133, 36/139, 1, 28, 7.2; 473/446, 422, 452, 4; 273/DIG. 18; 434/251, 247
See application file for complete search history.

(56) References Cited

U.S. PATENT DOCUMENTS 4,065,861 A * 1/1978 Pelfrey ..... 36/133
4,711,043 A * 12/1987 Johnson et al. ..... 36/139
5,216,827 A 6/1993 Cohen
5,737,858 A 4/1998 Levy
5,897,446 A * 4/1999 Wiseman et al. ..... 473/446
5,947,845 A * 9/1999 Canelas ..... 473/446
6,038,792 A 3/2000 Hauter
6,523,282 B1 2/2003 Johnston
2002/0043007 A1 4/2002 Hannah
2002/0115509 A1 8/2002 Hergert et al.
2005/0144812 A1 * 7/2005 Wheeler ..... 36/133
2007/0227047 A1 * 10/2007 Zaza ..... 36/133

FOREIGN PATENT DOCUMENTS

GB 2257893 A * 1/1993

OTHER PUBLICATIONS

User Manual Online, 9 pages, downloaded on May 31, 2005 http://www.loopball.com.

* cited by examiner

*Primary Examiner*—Ted Kavanaugh
(74) *Attorney, Agent, or Firm*—Weaver Austin Villeneuve & Sampson LLP

(57) ABSTRACT

A soccer training apparatus for teaching a user the proper technique to stop a soccer ball. The training apparatus includes a contact patch assembly having a contact region, and a strap mechanism configured to removably mount around a foot and shoe of the user in a manner orienting the contact region generally at an instep portion of the user's foot. The contact region, in one example, includes one of a hook or loop material. The training apparatus further includes a soccer ball having an exterior surface containing the other of a loop or hook material that is adapted to cooperate with the contact region of the contact patch assembly to promote attachment of the soccer ball to the contact region. Such contact and adherence indicates precision locational contact of the foot or shoe with the soccer ball at the instep portion thereof.

23 Claims, 8 Drawing Sheets

SOCCER TRAINING APPARATUS AND METHOD

RELATED APPLICATION DATA

The present application claims priority under 35 U.S.C. §119 to U.S. Provisional Application Ser. No. 60/658,253, naming Kos and Koffi as inventors, filed Mar. 2, 2005, and entitled the same, the entirety of which is incorporated herein by reference in its entirety for all purposes.

TECHNICAL FIELD

The present invention relates to methods and apparatus for sports equipment and training aids, and more particularly, relates to soccer training devices.

BACKGROUND ART

Soccer, which is increasing in popularity in the United States and is played throughout the world, is a sport played with a ball that is predominantly controlled with the feet. To excel in this sport, a player must naturally possess a combination of excellent eye-foot coordination, foot control, and ball control skills. One of the fundamental soccer techniques is stopping the ball with the feet.

In the U.S., many children are not taught the proper way to stop a soccer ball. This results in poor ball-control skills and a lack of confidence in being able to control the ball. Oftentimes, this will results in players simply kicking the ball without attempting to control it first. In addition, many current teaching methods and techniques do not place the proper or enough emphasize on stopping the ball. As a result, many soccer players never learn and develop this very important skill.

Accordingly, there is a need for a soccer training aid that develops and teaches the fundamental skill of stopping the ball using the proper portions of the foot for the greatest control.

DISCLOSURE OF INVENTION

The present invention provides a soccer training apparatus including a contact patch device configured to removably attach to a foot or a shoe of a user at a selected strategic location of the foot or shoe. The training apparatus further includes a soccer ball having an exterior surface that is adapted to cooperate with a contact region of the contact patch device to at least one of removably attach to the contact region and produce an audible sound upon contact with the contact region. By adhering or attaching to the contact patch device and/or producing a distinct audible sound, the user will become accustomed to the correct contact of the foot or shoe with the soccer ball at the selected strategic location.

Accordingly, the present invention provides a simplistic soccer training aid that facilitates the teaching of some of the fundamental skills required in soccer (e.g., "control touch").

In one specific embodiment of the present invention, the contact region of the patch device is configured to be positioned at an instep of the user's foot. In another arrangement, the length of the width is greater than the length of the height. In yet another configuration, the contact region is substantially pentagonal shaped.

In still another specific embodiment, the patch device includes an adhesive backing to removably mount to the instep portion of the user's foot or shoe. In another configuration, the patch device includes a strap mechanism configured to removably mount around the foot and shoe of the user. The strap mechanism, in one specific embodiment, includes a heel strap portion adapted to extend around a heel portion of the foot and shoe of the user, and a middle strap portion adapted to extend around the arch portion of the foot and shoe of the user.

In yet another specific arrangement, the contact region and the exterior surface of the soccer ball include at least one of a hook and loop material, while the exterior surface of the soccer ball includes the other of loop and hook material.

Another specific embodiment includes a reducing patch having a backside surface configured to removably adhere to the contact region of the patch device, and a front side surface configured to substantially non-adhere to the exterior surface of the soccer ball. In one embodiment, the reducing patch includes a contact aperture extending from the front side to the backside that enables exposure of a strategic portion of the contact region therethrough when the reducing patch is attached to the patch device contact region. Hence, when the backside surface of the reducing patch is attached to the contact region, an effective surface area thereof is reduced. In order to contact the remaining exposed surface area, thus, a more precise control of the foot is required to place the contact region in contact with the soccer ball.

Yet another specific configuration provides a cover patch having a backside surface configured to removably adhere to the contact region of the patch device, and a front side surface configured to substantially non-adhere to the exterior surface of the soccer ball. Once the backside surface of the reducing patch is attached to the contact region, such as during non-use, an effective surface area of the contact region is substantially covered and will prevent anything else adhering to the contact region.

In another aspect of the present invention, a soccer training apparatus is provided having a contact patch assembly, having a contact region, and a strap mechanism configured to removably mount around a foot and shoe of a user. The strap mechanism is configured to orient the contact region generally at an instep portion of the user's foot. The contact region includes one of a hook or loop material. The training apparatus further includes a soccer ball having an exterior surface containing the other of a loop or hook material that is adapted to cooperate with the contact region of the contact patch assembly to promote attachment of the soccer ball. Such adhered contact indicates precision locational contact of the foot or shoe with said soccer ball at the instep portion thereof.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

BEST MODE OF CARRYING OUT THE INVENTION

Figure 1:
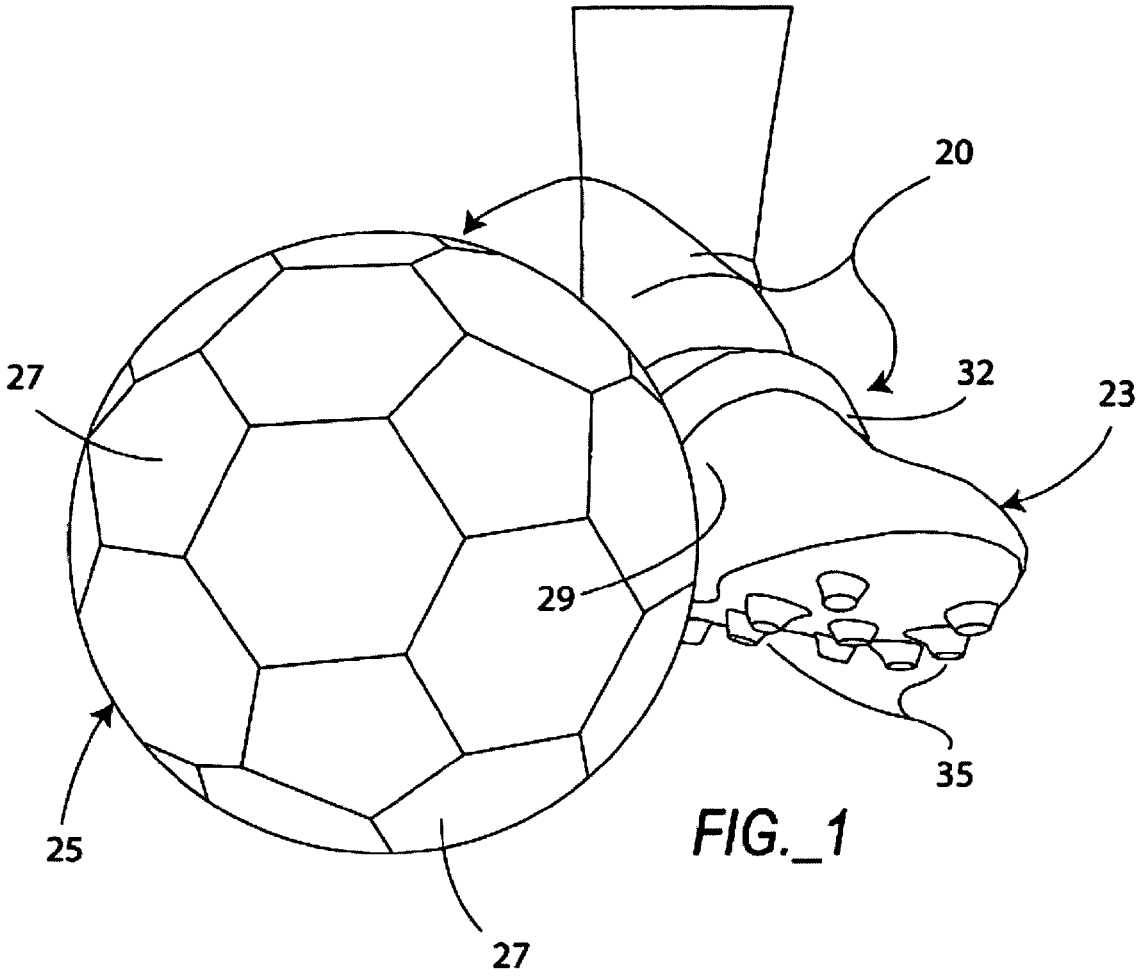
FIG. 1 is a front perspective view of the training apparatus designed in accordance with the present invention, mounted to a user's left shoe and shown with a ball in a stopped position.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various FIGURES.

Figure 2:
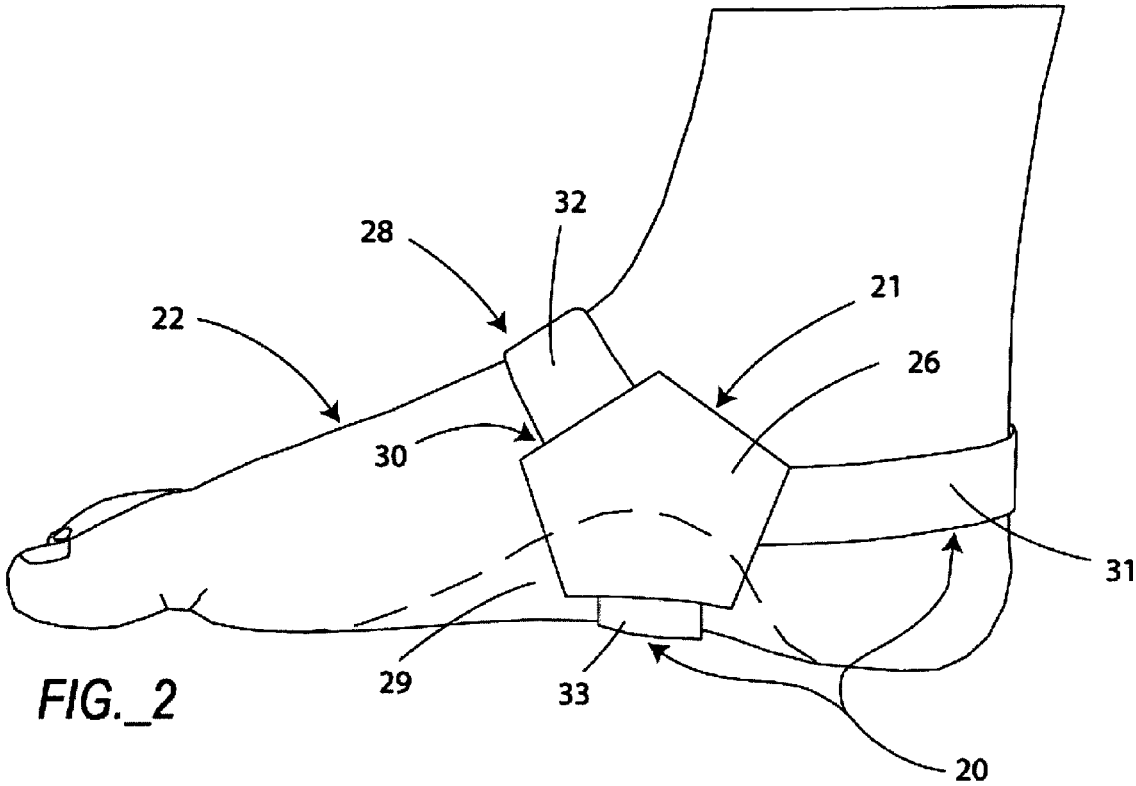
FIG. 2 is an enlarged side elevation view of the training apparatus similar to that of FIG. 1 mounted to a user's right foot and illustrating a contact patch.
Figure 3:
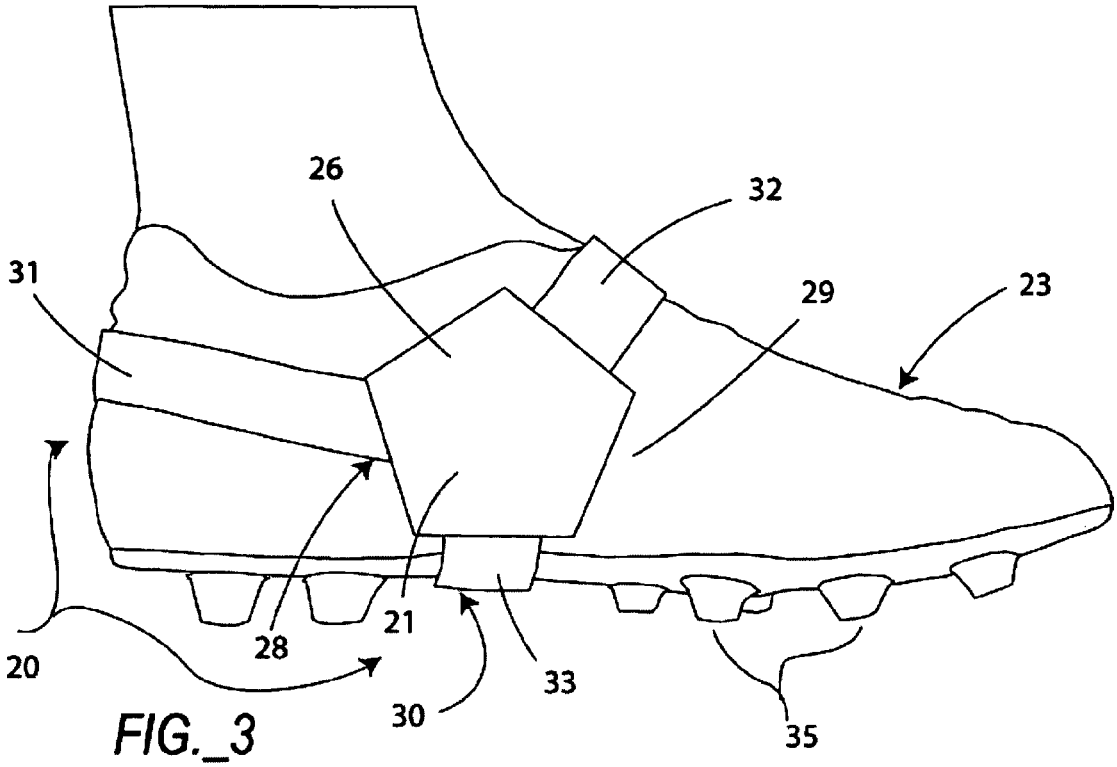
FIG. 3 is an enlarged side elevation view of the training apparatus of FIG. 1 mounted to a user's left shoe.
Figure 4:
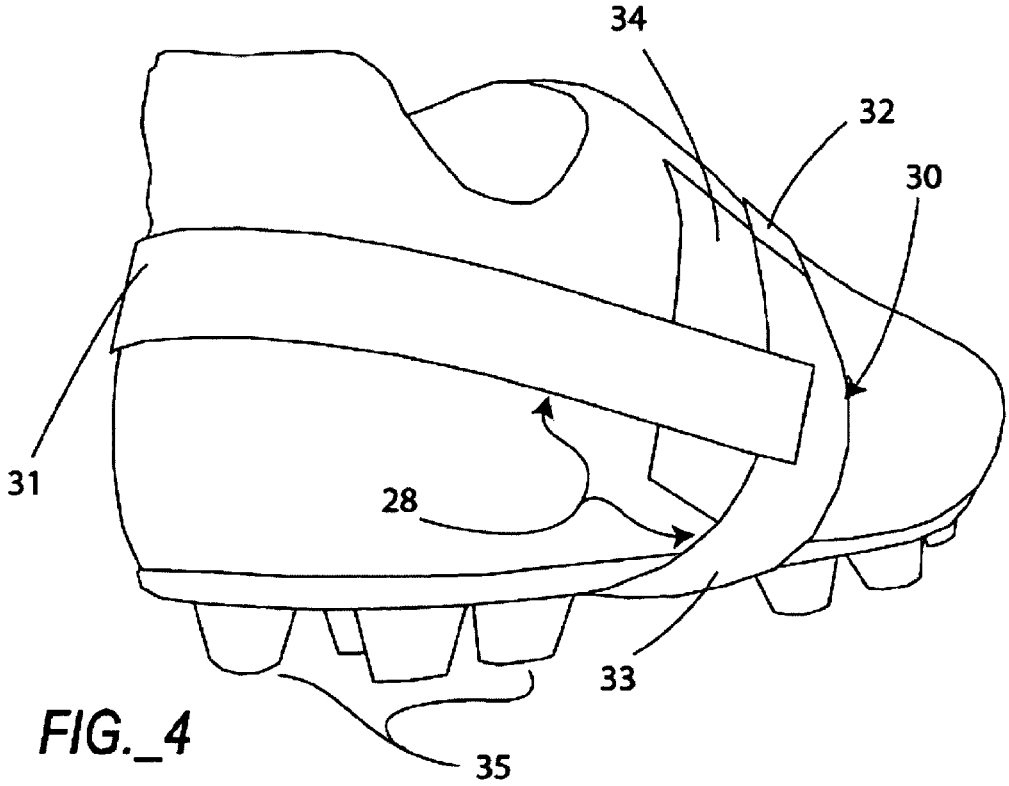
FIG. 4 is a rear perspective view of the training apparatus of FIG. 3 illustrating a strap mechanism for removable mounting to the right shoe.

Referring now to FIGS. 1-3, a soccer training apparatus, generally designated 20, is provided that aids the development of one or more fundamental skills of soccer known as "control touch". The soccer training apparatus 20 includes a contact patch device 21 that is configured to removably attach to a foot 22 or a shoe 23 of a user at a selected strategic location thereof. The training apparatus 20 further includes a soccer ball 25 having an exterior surface 27 that is adapted to cooperate with a contact region 26 of the contact patch device 21 to at least one of removably attach to the contact region 26 and/or produce an audible sound upon contact with the contact region 26. By adhering or attaching to the contact region of the contact patch and/or producing a distinct audible sound, the user will become accustomed to the correct feel and contact of the foot or shoe with the soccer ball at the selected strategic location.

Accordingly, the soccer teaching aid of the present invention tactilely and/or audibly teaches and reinforces the fundamental skill of "control touch" which is the physical act of the ball making contact with the foot. Once a certain level of 'control touch' is achieved, a player can then begin learning a technique known as the "first-touch" which is the art of controlling where the ball ends up after the ball initially contacts the foot (aka, the control-touch). Generally, the better a player is at executing this first-touch technique, the better player they will become. The art of correctly stopping the ball, however, begins the fundamental skill of "control-touch".

In accordance with the present invention, the goal of the user is to engage the ball with their feet at the proper target location, and have the ball fasten or adhere to the contact region 26 of the patch device 21, when the ball is passed by another player (see FIG. 1). To achieve this, the player typically uses the inside-of-the-foot, at the in-step, to cushion and dissipate the inertia of the ball in an effort to minimize or limit the release distance of the ball once it comes off the foot. If the player applies an insufficient amount of "cushion" (i.e., dampening upon contact with the ball), even though accurate contact is made, the ball may still release from the contact patch device 21. In other words, the soccer training apparatus 20 of the present fosters the development of "soft feet", similar to the skill of "soft hands" that a successful wide receiver develops in American football. In the event that the player accurately contacts the ball at the target area, but an insufficient amount of "cushion" is applied so that the ball still releases from the contact patch, such release will cause a distinct audible sound that at least indicates accurate and proper contact with the ball at the target location of the contact patch. Use of this device, hence, helps reinforce these fundamental skills through the act of muscle memory. When the training apparatus is removed from the foot or shoe, and a standard soccer ball utilized, the player will have much improved control and stopping skills.

The training apparatus 20, as mentioned above and shown in FIGS. 1 and 2, consists of two primary components: the ball 25 and the contact patch device 21. The exterior surfaces of the soccer ball 25 and the contact region 26 of the patch device 21, which is removably affixed to the player's foot or shoe 23 either directly or via a strap mechanism, cooperate to adhere to one another upon contact therewith. In one specific embodiment, both the exterior surface 27 of the ball 25 and the contact region 26 of the patch device cooperate to adhere to one another. It will be appreciated, however, that only one of the exterior surface of the ball and the contact patch contain a material having sufficient adhesive properties, to retain the other of the exterior surface upon contact therewith. More preferably, however, both exterior surfaces contain an embedded or surface mounted material that will adhere itself to one another when they come into contact.

It will be appreciated that any combination of adhering material that can be pulled apart and re-adhered without damage to any of the components could be used. An example of an embedded material may include some material containing magnetic properties. An example of a surface mounted or external material may include a hook and loop material (more commonly know as 'VELCRO®'). The loop component is affixed to the entire outer surface of the ball. Another example of a surface mounted material may include an adhesive material, or materials with magnetic properties or the like.

In one specific embodiment, the surface of the ball is fitted with the loop material while the contact region of the contact patch device incorporates a hook material. In this manner, should the user desire to use the training apparatus with their bare feet, the loop material may be gentler against the user's foot during contact with the ball. While the present invention only illustrates the loop component being mounted to the ball, and the hook component being applied to the contact patch device 21, it will be appreciated that the hook and loop components can be reversed without departing from the true spirit and nature of the present invention.

Preferably, the hook or loop material is mounted to the exterior surface 27 of the ball through stitching or through an adhesive. While any shape combination of patches of the hook or loop material can be applied to cover the exterior of the ball, more conventional hexagonal-shaped patches result in a more natural soccer ball appearance. A typical soccer ball pattern, for instance, uses twenty hexagonal shapes and twelve pentagonal shapes In accordance with the present invention, while the exterior surface 27 of the ball 25 is covered with the adhesive material, such as VELCRO®, the ball still must function like a conventional soccer ball under normal playing conditions. Hence, a player should still be able to kick, bounce, roll, punt, and pump it up easily. Furthermore, even though the exterior surface 27 of the ball 25 includes the adhesive material, the ball should still be configurable. For example, the ball, like a standard soccer ball should be able to be inflated or deflated. Such an adjustment can alter the ease and/or difficulty of cushioning a ball. For instance, a reduced inflation produces less bounce, and thus eases adherence of the ball against the contact region 26 of the patch device 21. In contrast, raising the inflation level increases the balls bounce, thus increasing the difficulty of adherence when the contact region contacts the ball. Generally, however, the option to inflate and deflate a ball is an optimal way to vary the degree of difficulty.

Referring now to FIGS. 2 and 3, the patch device 21 is shown affixed to the player's foot or their shoe 23. Preferably, the patch device 21 is oriented to position the contact region 26 thereof proximal to the instep 29 of a user' foot 22. Such an orientation of the patch device is preferable since the instep is one of the most important parts of the body in soccer. Briefly, not only is the instep 29 used to stop the ball, but it is also applied for nearly all passing to assure pinpoint accuracy.

The top of the foot (where the laces are typically located) is sometimes referred to as the instep. However, recently in the soccer vernacular and for the purposes herein, the instep refers to the inside portion of the foot, and more specifically, at the top of the foot's arch or just rearward of the arch. By stopping it more towards the back of the arch, there is more support in that area because of the leg providing additional stability that results in more control. If the ball is stopped further up towards the toe portion, while a player will still be able to stop the ball with a high degree of efficiency, sometimes the control of the ball will be reduced since there is no leg to support the foot.

The instep portion 29 of the foot 22 is also selected to position the patch device since it is the largest, flattest, least encumbered, and most solid area of the foot. This flat surface of the instep is particularly conducive to stopping the ball. Due to the size of the instep, this portion of the foot is more forgiving than other parts thereof. However, while the instep 29 is the preferred section of the foot 22 to stop a ball with, it is not a natural or comfortable motion to stop the ball. The device of the present invention, thus, reinforces these skills through the act of muscle memory.

As above indicated, the placement of the patch device 21 is preferably located at the user's instep of the foot. Therefore, the contact patch device 21 (with or without a strap) is preferably located on the inside-of-the-foot at the top of the arch (see FIGS. 2, 3 and 7). In this specific configuration, the contact region 26 is shaped and sized to cover the entire instep region 29 of the player's foot 22 that generally encompasses the arched middle part of the human foot between the ball of the foot and the ankle. It will be appreciated, however, that the contact patch device 21 may be smaller than the entire instep of one's foot, and may further be repositioned within this region depending upon the player's personal preference. In one embodiment, the shape of the contact patch may be oblong, having its widest section directly at the arch portion of the player's foot. In another more decorative example, the patch device may be hexagon or pentagon shaped to simulate or replicate the basic soccer ball pattern.

Briefly, while the instep 29 of the foot 22 is the most prudent position for the patch device 21 for use primarily as a target, the patch device may also be placed at other sections of the foot used in soccer to stop or control the ball. These other placement sections include the laces (top-of-the-foot), the outside-of-the-foot, or the bottom-of-the-foot; all of which develop other stopping skills using the cushioning method. Other body parts can also be used in soccer to stop a ball (for example, thighs and the chest). To develop these skills using the device, the size of the patch should be proportionate to the size of the body part or parts the player wishes to use to stop the ball.

The patch device 21 can be affixed to the foot or shoe 23 using various mounting techniques that secure the contact region 26 at the strategic location along the foot (e.g. the instep). In one configuration, the contact patch device 21 may be a standalone patch that is be sewn directly to the shoe 23, or the application of an appropriate adhesive backing or similar attachment process. Such backing, for instance, includes double sided tape or glue. Another option is to adhere or mount a piece of 'hook' VELCRO® or the like, roughly the same size as the patch device 21, to the shoe 23. This configuration would permit the user to easily place or remove the patch device from their foot.

In another specific embodiment, as shown in FIGS. 2-6, 8 and 9, the training apparatus 20 may include a flexible strap mechanism 28 that removably mounts the patch device 21 around the shoe or foot via one or more straps. The strap mechanism 28 can be easily adjusted and tightened around the shoe or foot for strategic placement of the patch device 21 and/or to accommodate varying foot sizes and shapes.

Preferably, the strap mechanism 28 includes a middle strap portion 30 that is configured to be firmly placed around the middle section of the user's foot 22. This middle strap portion 30 prevents the patch device 21 from rotating about the middle section and slipping under the arch section of the foot/shoe or slipping to the top portion of the foot/shoe (i.e., where the shoelaces are oriented). The middle strap portion 30 consists of a top strap 32 (FIGS. 6 and 8) that extends over the top transverse portion of the foot, commonly referred to as the dorsum of the foot, and a bottom strap 33 (FIGS. 5 and 8) that extends under the bottom transverse portion of the foot, commonly referred to as the plantar surface of the foot. The top strap 32 (shown in FIGS. 4, 8 and 9) includes a coupling pad 34 upon which the bottom strap 33 and the heel strap 31 can mount thereto at an opposite side of the foot. It will be appreciated, of course, that this pad 34 could be located on either the end of the heel strap 31 or the bottom strap 33 as well.

The strap mechanism 28 further includes a heel strap portion 31 (FIGS. 4 and 8) that prevents the patch device 21 from sliding forward since with most feet, the transverse cross-sectional dimension of the foot narrows as you move forward from the instep section. Hence, since the heel strap portion 31 wraps around the heel of the user's foot, the patch device is prevented from forward displacement during use. Incidentally, the patch device 21 is prevented from sliding rearward toward the heel of the foot since the transverse cross-sectional dimension of one's foot is normally larger as you move rearward from the instep portion.

Figure 7:
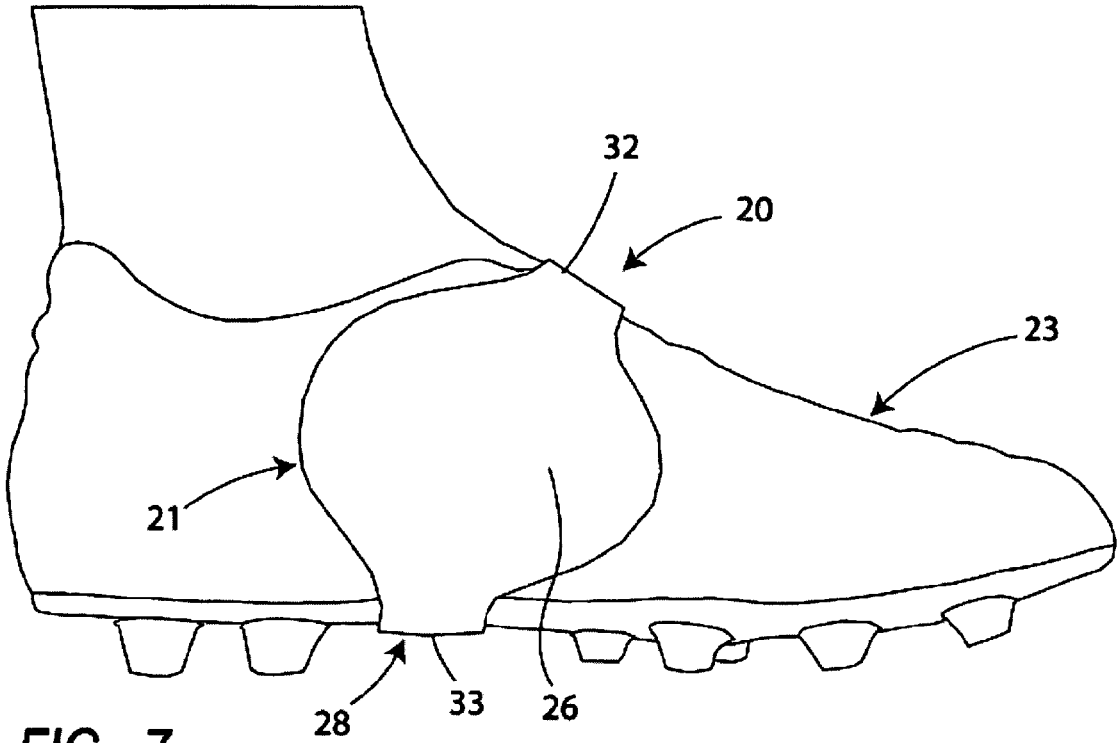
FIG. 7 is a side elevation view of the training apparatus having an alternative embodiment strap mechanism and contact patch-shape mounted to the user's left shoe.
Figure 8:
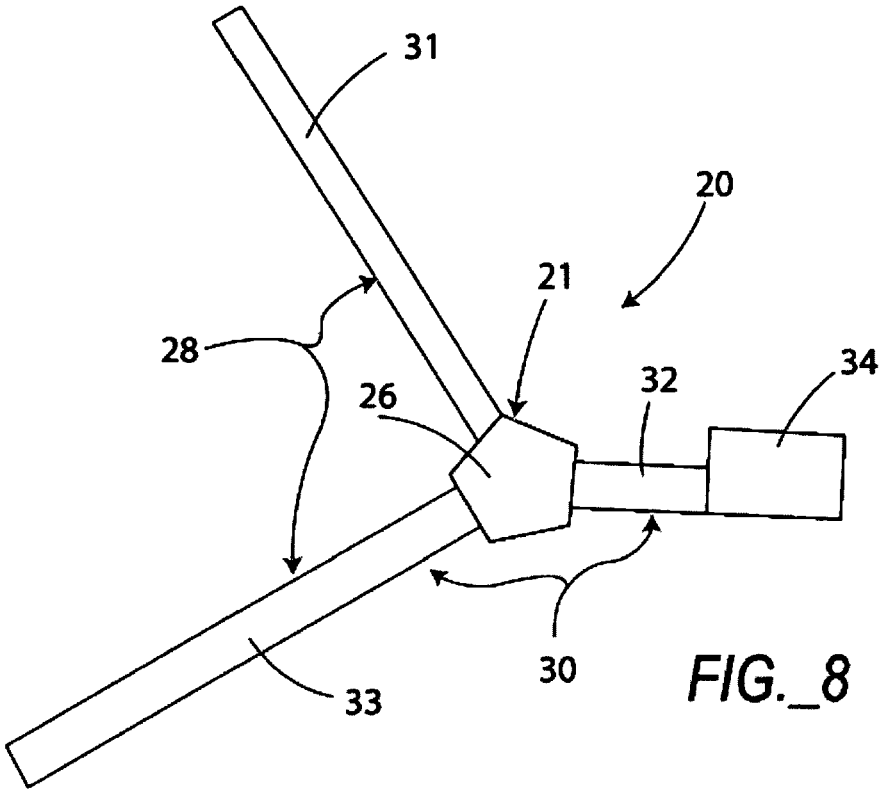
FIG. 8 is a reduced top plan view of the training apparatus of FIG. 3 laid out flat.
Figure 9:
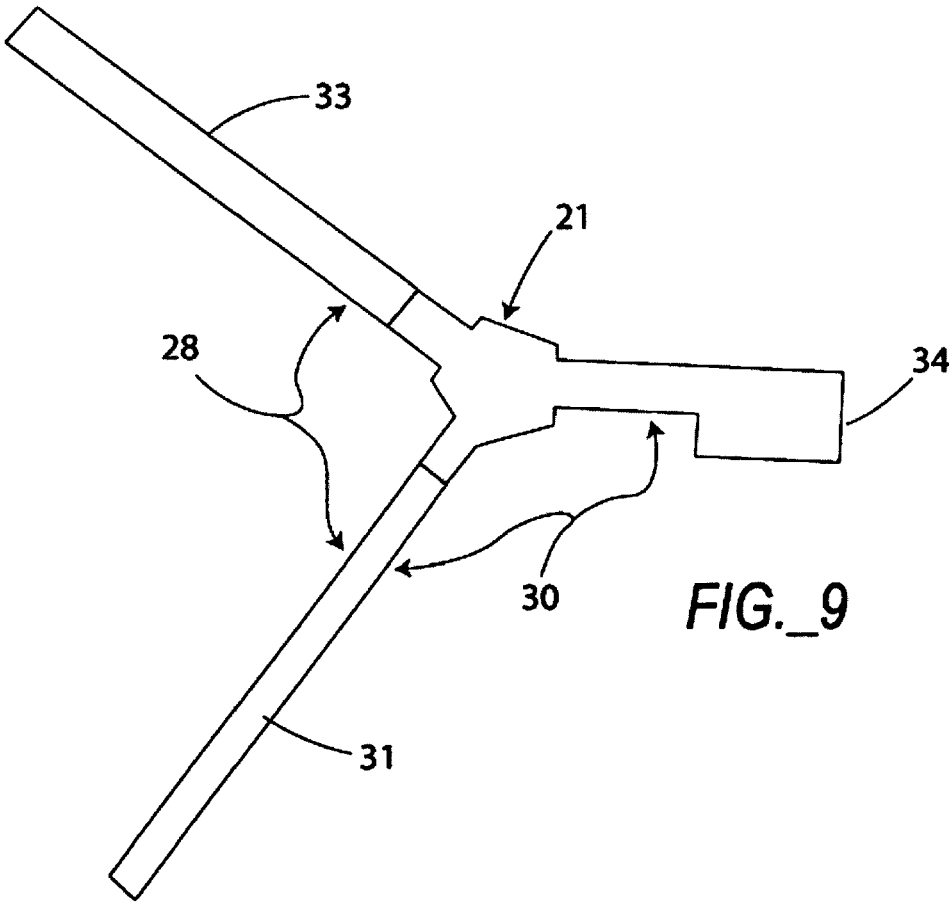
FIG. 9 is a bottom plan view of the training apparatus of FIG. 8.

Preferably, the strap mechanism 28 only has two points of contact (i.e., the heel strap portion 31 and the middle strap portion 30). Thus once a player is familiar with the use of the straps, they can be operated very quickly. It will be appreciated, however, that the training apparatus 20 may function with only one point of contact (e.g., the middle strap portion 30, indicated as top strap 32 and bottom strap 33, as shown in FIG. 7)

Each strap portion should be designed to not encumber the movement of the foot/shoe during play. For instance, in order to stop the ball properly with the instep portion of one's foot, the toe section is required to be pointed upward (while the heel is still on or slightly off the ground), and the foot is also required to be pointed out at a 90-degree angle in order to expose the instep to the ball. Hence, the manner in which the middle strap portion 30 wraps around the middle section of the shoe/foot should not impede this motion.

Figure 5:
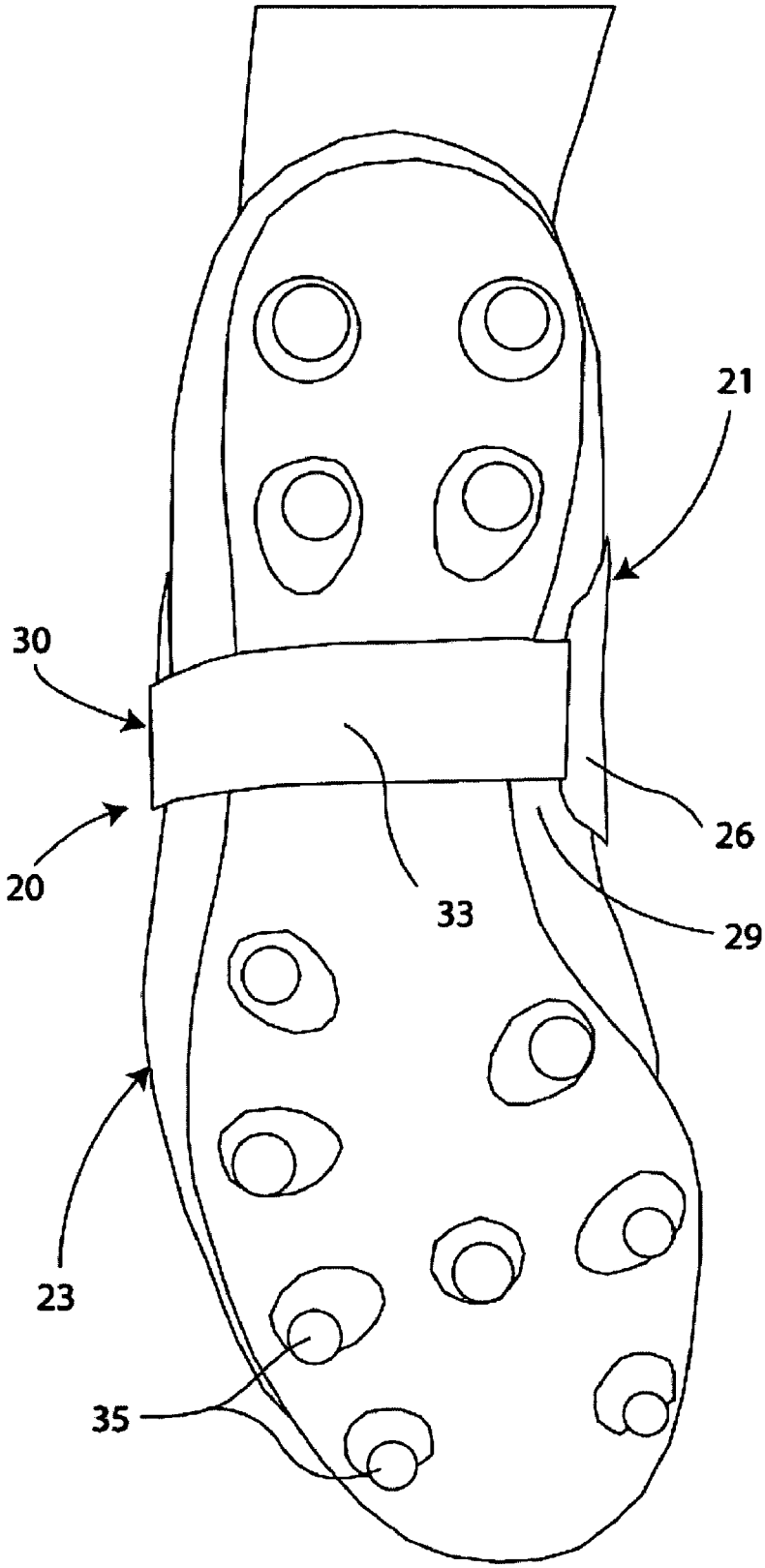
FIG. 5 is a bottom plan view of the training apparatus of FIG. 3.
Figure 6:
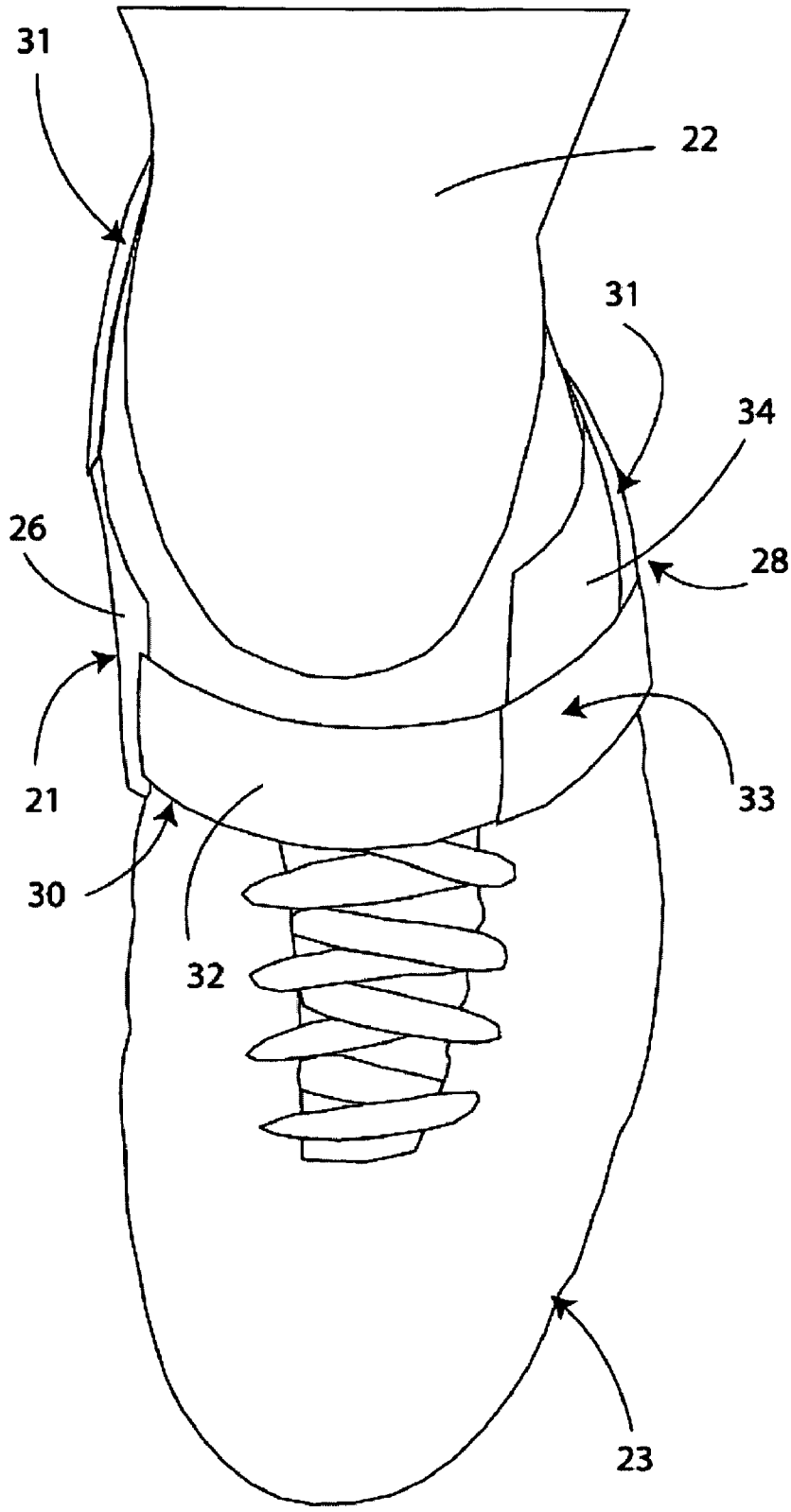
FIG. 6 is a top plan view of the training apparatus of FIG. 3.

Further, the strap portions must be relatively light in weight, and thin in width and thickness. By way of example, each strap portion is sufficiently thin in order to conform to the shape of the user's shoe/foot. Further, the width of the bottom strap 33 cannot be too wide since it must to fit in-between the cleats 35 on the bottom of the soccer shoe. Most outdoor soccer shoes are designed with cleats to provide players better traction on playing surfaces. The number of cleats varies as do their relative position on the sole of the shoe. Typically, however, the portion of the shoe that supports the arch does not contain any cleats. Because the contact patch device 21 will typically be wider than the gap between the front and rear cleats 35 under the arch, in one specific embodiment, the portion of the bottom strap 33 spanning this gap will be narrower so that it wraps around the bottom sole of the shoe (FIG. 5). Moreover, this design will keep the bottom strap cleaner and subject to less wear and tear.

Regarding the heel strap portion 31, it can be relatively narrow since this strap merely prevents the patch device 21 from moving forward of the instep portion. The top and bottom straps 32, 33, however, are slightly thicker than the heel strap so as to fit snuggly around the foot. Generally, the wider the middle strap portion, the less likely the straps will move/slip once in place.

The middle and heel strap portions 30, 31 can be connected using any conventional techniques that permit adjustability. This includes buckles, button, snaps, etc. In one specific configuration, the strap portions are respectively removably mounted through the application of VELCRO®. In this arrangement, the strap portions can be provided in a long length, and can be cut down to fit the shoe/foot. This permits the original strap to be a one-size-fits-all apparatus.

The top strap 32 should remain the same length but the outside coupling pad 34 that is an extension of the top strap can also be cut for a smaller shoe/foot. However, not too much can be cut since the coupling pad must have a sufficiently large area so that the bottom and heel straps can still connect to it.

It will be appreciated that a strap mechanism 28 configured for the instep of one foot (e.g., the right shoe/foot) can be utilized on the other foot (e.g., left foot) which will orient the patch device 21 to now cover the outside of the other foot (e.g., left foot). While this interchangeability is functional to an extent, the patch device in some instances may be positioned too far back on the outside of the other foot to be effective. That is, the patch device 21 may be too far rearward to reinforce stopping the ball with the outside of the foot. In soccer, the ball can be stopped with any part of the foot, but for the outside of the foot, a player should ideally stop the ball further in front of the foot.

In accordance with the present invention, the manner in which the strap portions are attached to the patch device 21 (i.e., from the top, bottom, and heel straps) should be free of any protrusions that may injure or cause harm to the user in the event of contact therewith. That is, the coupling of these straps to the patch device 21 is preferably free of any buckles, snaps or rings, etc. In one example, hence, these straps may be integrally formed with the patch device, or may be sewn, glued or attached through a VELCRO® application.

In another specific embodiment of the present invention, the contact patch device 21 may be provided in various sizes and shapes. By increasing or decreasing the surface area of the contact region, the user can be less accurate or be required to be more accurate to properly contact the contact region 26 to the surface of the ball 25. For example, the contact region 26 of the contact patch device 21 can be smaller or can be reduced so that more precision is required in order to stop the ball and for engagement to take place. In another example, while the pentagon shape of the contact patch device 21 has been shown and described as decorative, its orientation is functional. By orienting the bottom edge of the pentagon-shaped contact patch-shaped device 21 generally parallel to the bottom of the shoe (or ground), the edge of the patch that has the top strap 32 protruding from it has a parallel orientation to the top angle of the foot or shoe. With this orientation, assuming that the bottom edge is positioned properly, the pentagonal shape of the patch will not only facilitate positioning the patch properly, but more importantly, it will position the top strap 32 and its mounting mechanism properly so that the bottom strap 33 and the heel strap 31 can correctly form a snug fit.

Figure 10:
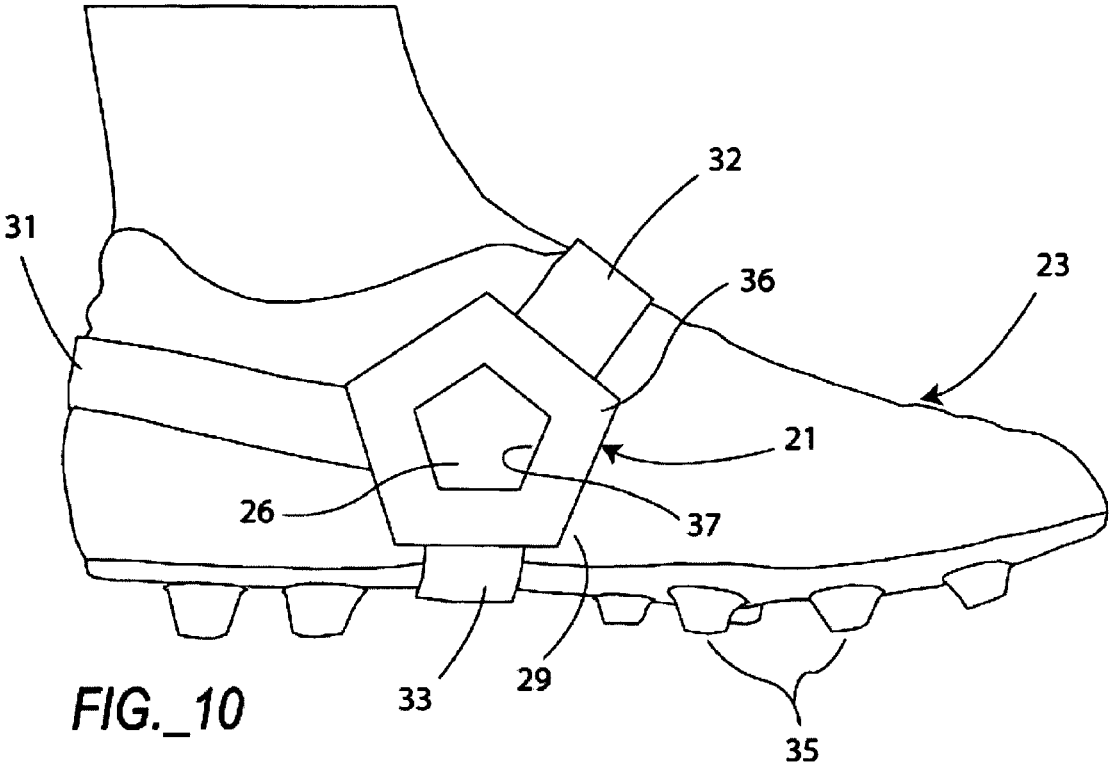
FIG. 10 is a side elevation view of the training apparatus of FIG. 3 having a reducing patch mounted to the contact patch.

Another technique applied to perform a similar function is to provide a reducing patch 36 that can be positioned over at least a portion of the contact region 26 of the patch device 21 (FIG. 10). In this manner, the reducing patch 36 will cover a portion of the contact region 26 that reduces the effective area of the contact region 26. In one configuration, the reducing patch 36 includes a backside surface containing a material similar to that of the soccer ball 25 that is capable of removably adhering to the contact region 26 of the patch device 21. The front side surface, however, is non-adherent to soccer ball surface. By covering only a portion of the contact patch device 21, the remaining exposed contact region 26, albeit reduced in area, is capable of adhering to the ball.

FIG. 10 best illustrates one particular example in which a central passage 37 is provided in the reducing patch 36 that permits exposure of a smaller central portion of the contact region 26 when the reducing patch is mounted thereto. It will be appreciated that depending upon the desired exposure area, the central passage 37 can be shaped accordingly. By way of example, the central passage 37 is not only polygonal-shaped, but can be oblong-shaped, oval-shaped or circular-shaped, and can also be offset from a central axis of the contact region. Moreover, by rotating the reducing patch 36 relative to the patch device 21, the central passage 36 can be similarly rotated, which in effect alters the orientation of the exposed contact region.

Figure 11:
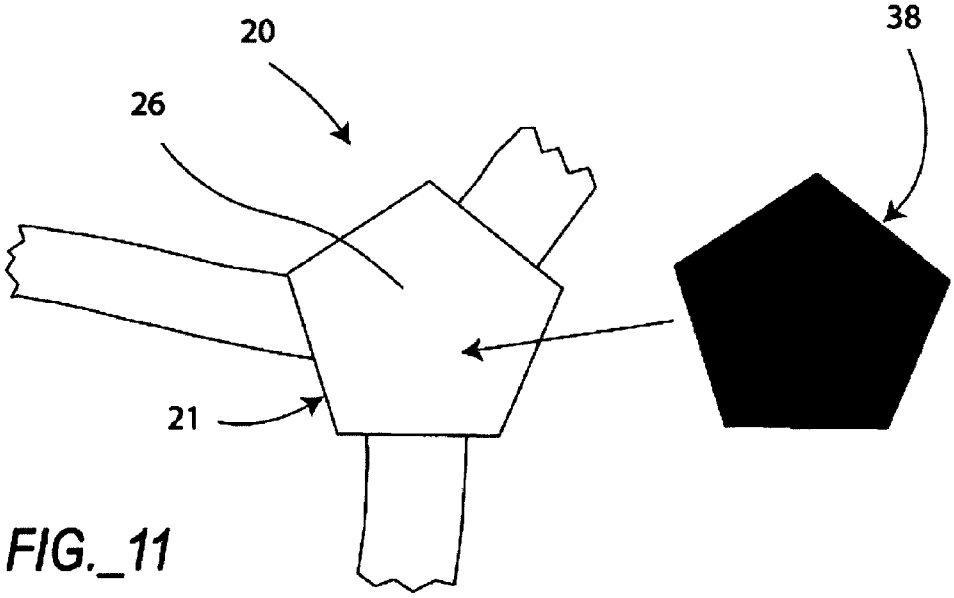
FIG. 11 is a fragmentary, exploded, side elevation view of the training apparatus showing use of a cover patch.

In still another specific embodiment, a cover patch 38 (FIG. 11) can be provided which is configured to cover the entire contact region 26. Similar to the reducing patch 36, a backside surface of the cover patch 38 containing a material similar to that of the soccer ball 25 which is capable of removably adhering to the contact region 26 of the patch device 21. The front side surface of the cover patch 38, however, is non-adherent to soccer ball surface. When the soccer training apparatus 20 is not in use, thus, by placing the cover patch 38 over the patch device 21, the contact region 26 thereof is prevented from attaching itself to other articles. This is extremely useful when storing the training apparatus during non-use for example. Another important use of the cover patch 38 is to prevent adherence of the patch device 21 to the soccer ball when the training apparatus is still mounted to the foot or shoe. By way of example, when using this device for training, the cover patch 38 can be placed over one contact patch device 21 on one foot while the user can practice stopping the ball (with the exposed target) with the other foot. In this arrangement, passing the ball back to another player/trainer is much easier with the cover patch 38. Additionally, both patch devices can be covered by a cover patch to allow for unimpeded play without having to spend the time to remove the devices.

In yet another specific embodiment of the present invention, as mentioned above, contact with the ball 25 against the contact patch device 21 may result in a distinct audible sound as well as adhering to the patch. Application of the VELCRO® as the adhesive will inherently produce a distinct sound when the ball contacts the contact region 26. In other examples, however, a contact device or the like may be provided at the contact patch 21 that produces or causes to produce an audible sound to signify contact with the ball therewith. Other conventional sound producing techniques can be employed as well.

It is worthwhile to note that the extra space on the coupling pad 34 can be used to store the reducing patch or patch cover when not in use. This gives the player easy access to either patch quickly should there be a need.

What is claimed is:

1. A soccer training apparatus comprising:

a contact patch device configured to removably attach to a foot or a shoe of a user at an instep portion of the foot or shoe; and a soccer ball having an exterior surface that is adapted to cooperate with a contact region of the contact patch device to removably attach to the contact region upon contact with the contact region to indicate correct contact of the foot or shoe with said soccer ball at the instep portion.

2. The training apparatus according to claim 1, wherein said patch device includes an adhesive backing.

3. The training apparatus according to claim 1, wherein said patch device includes a strap mechanism configured to removably mount around one of the foot and shoe of the user.

4. The training apparatus according to claim 3, wherein said strap mechanism includes a heel strap adapted to extend around a heel portion of the foot and shoe of the user.

5. The training apparatus according to claim 4, wherein said strap mechanism includes a middle strap adapted to extend around an arch portion of the foot and shoe of the user.

6. The training apparatus according to claim 5, wherein said middle strap is wider than said heel strap.

7. The training apparatus according to claim 3, wherein said strap mechanism includes a bottom strap adapted to extend under a mid section of the foot and shoe of the user, and a top strap adapted to extend over the mid section of the foot and shoe of the user.

8. The training apparatus according to claim 1, wherein the contact region and the exterior surface of the soccer ball include at least one of a hook and loop material.

9. The training apparatus according to claim 8, wherein said exterior surface of the soccer ball includes the loop material, and said contact region of the patch device includes the hook material.

10. The training apparatus according to claim 1, wherein said contact region is substantially pentagon-shaped.

11. The training apparatus according to claim 1, further including:

a reducing patch having a backside surface configured to removably adhere to the contact region of the patch device, and a front side surface configured to substantially non-adhere to the exterior surface of the soccer ball such that when the backside surface of the reducing patch is attached to the contact region, an effective surface area thereof is reduced.

12. The training apparatus according to claim 11, wherein said reducing patch includes a contact aperture extending from the front side surface to the backside surface that enables exposure of a strategic portion of the contact region therethrough when the reducing patch is attached to the patch device contact region.

13. The training apparatus according to claim 1, further including:

a cover patch having a backside surface configured to removably adhere to the contact region of the patch device, and a front side surface configured to substantially non-adhere to the exterior surface of the soccer ball such that when the backside surface of the reducing patch is attached to the contact region, an effective surface area of the contact region is substantially covered.

14. A soccer training apparatus comprising:

a contact patch assembly including a contact region, and a strap mechanism configured to removably mount around a foot and shoe of a user in a manner orienting the contact region generally at an instep portion of the user's foot, said contact region including one of a hook or loop material; and a soccer ball having an exterior surface containing the other of a loop or hook material that is adapted to cooperate with the contact region of the contact patch assembly to promote attachment of the soccer ball to the contact region and indicate precision locational contact of the foot or shoe with said soccer ball at the instep portion thereof.

15. The training apparatus according to claim 14, wherein said strap mechanism includes a heel strap adapted to extend around a heel portion of the foot and shoe of the user.

16. The training apparatus according to claim 15, wherein said strap mechanism includes a middle strap adapted to extend around an arch portion of the foot and shoe of the user.

17. The training apparatus according to claim 14, further including:

a reducing patch having backside surface configured to removably adhere to the contact region of the patch device, and a front side surface configured to substantially non-adhere to the exterior surface of the soccer ball such that when the backside surface of the reducing patch is attached to the contact region, an effective surface area thereof is reduced.

18. The training apparatus according to claim 17, wherein said reducing patch includes a contact aperture extending from the front side to the backside that enables exposure of a strategic portion of the contact region therethrough when the reducing patch is attached to the patch device contact region.

19. The training apparatus according to claim 14, further including:

a cover patch having a backside surface configured to removably adhere to the contact region of the patch device, and a front side surface configured to substantially non-adhere to the exterior surface of the soccer ball such that when the backside surface of the reducing patch is attached to the contact region, an effective surface area of the contact region is substantially covered.

20. A soccer training apparatus comprising:

a contact patch device configured to removably attach to a foot or a shoe of a user at a selected strategic location of the foot or shoe, said contact region including one of a hook or loop material; and a soccer ball having an exterior surface containing the other of a loop or hook material that is adapted to cooperate with a contact region of the contact patch device to at least one of removably attach to the contact region and produce an audible sound upon contact with the contact region, either of which indicate correct contact of the foot or shoe with said soccer ball at the selected strategic location.

21. The training apparatus according to claim 20, wherein said exterior surface of the soccer ball includes the loop material, and said contact region of the patch device includes the hook material.

22. The training apparatus according to claim 20, wherein said patch device includes a strap mechanism configured to removably mount around one of the foot and shoe of the user.

23. The training apparatus according to claim 22, wherein said strap mechanism includes a bottom strap adapted to extend under a mid section of the foot and shoe of the user, and a top strap adapted to extend over the mid section of the foot and shoe of the user.

* * * * *